US006767005B1

(12) United States Patent
Tipple

(10) Patent No.: US 6,767,005 B1
(45) Date of Patent: Jul. 27, 2004

(54) FENCING SYSTEM

(75) Inventor: Roger Tipple, County Durham (GB)

(73) Assignee: CRH Fencing Limited, Doncaster (GB)

( * ) Notice: Subject to any disclaimer, the term of this patent is extended or adjusted under 35 U.S.C. 154(b) by 0 days.

(21) Appl. No.: 10/069,424

(22) PCT Filed: Sep. 8, 2000

(86) PCT No.: PCT/GB00/03464

§ 371 (c)(1),
(2), (4) Date: Feb. 19, 2002

(87) PCT Pub. No.: WO01/18330

PCT Pub. Date: Mar. 15, 2001

(30) Foreign Application Priority Data

Sep. 9, 1999 (GB) ..... 9921204

(51) Int. Cl.[7] ..... E04H 17/14
(52) U.S. Cl. ..... 256/65.09; 256/65.02
(58) Field of Search ..... 256/19, 21, 22, 256/24, 25, 31, 59, 64, 65.01, 66, 67, 68, 69, 65.02, 65.09

(56) References Cited

U.S. PATENT DOCUMENTS 327,717 A * 10/1885 Phillips ..... 256/69
3,524,627 A * 8/1970 Boyanton ..... 256/67 X
4,015,826 A * 4/1977 Lauzier ..... 256/59
4,123,183 A * 10/1978 Ryan
4,599,843 A * 7/1986 Ingvarsson
5,529,289 A * 6/1996 Lancer, Sr. ..... 256/66
5,581,868 A * 12/1996 Bisch

FOREIGN PATENT DOCUMENTS

| | | |
|---|---|---|
| CH | 482 087 | 1/1970 |
| DE | 1 684 883 | 11/1969 |
| DE | 296 11 017 | 10/1996 |
| FR | 2 309 118 | 11/1976 |

* cited by examiner

*Primary Examiner*—Gregory J. Binda
*Assistant Examiner*—Ryan M. Flandro
(74) *Attorney, Agent, or Firm*—Hebert Dubno

(57) ABSTRACT

A fencing system which includes a plurality of pales (20), one or more substantially horizontal rails (10), the rails including a substantially flat surface against which the pales are set, and the pales including a tubular cross section comprising a tubular wall a part of which is provided with holes (28) through which a bolt (15) or the like is passed to secure the pales. The cross section of the pale has a shape which is elongate in the direction of the rail. Further, the section includes a generally convex surface facing away from the rail. The section also includes a generally concave or re-entrant surface, so that the fastening means may engage with this surface and be concealed by this surface when the pale is regarded from side of the pale opposite to the concave surface.

8 Claims, 2 Drawing Sheets

FENCING SYSTEM

CROSS REFERENCE TO RELATED APPLICATIONS

This application is a national stage of PCT/GB00/03464 filed 8 Sep. 2000 and is based upon U.S. provisional application UK 89 21204.5 of 9 Sep. 1999 under the International Convention.

FIELD OF THE INVENTION

The present invention relates to a fencing system, in particular, but not exclusively, to palisade fencing.

BACKGROUND OF THE INVENTION

In a known type of palisade fencing, vertical pales are attached to a number of horizontal rails. These in turn are attached to vertical posts, which are set in the ground. The pales are usually bolted or riveted to the horizontal rails.

A pale is conventionally a strip of material such as metal of generally curved cross section, and is mounted upon the horizontal rails by its concave surface, so as to present its convex surface. When using such a palisade for an enclosed boundary, these convex surfaces are usually facing outwards. A known pale has a cross section of a flattened trefoil shape. Such a pale is usually formed by cold rolling a strip of metal.

Holes through the thickness of the pale are formed, each hole corresponding to a hole in the horizontal rail to which the pale is to be attached. A bolt is then used to fasten the pale and the horizontal rail, the head of the bolt being upon the convex surface of the pale. Similar attachment means such as rivets or the like, may be substituted.

This bolt head is very apparent, and offers an enticing target for vandals. Should the bolt head be removed, by being sheared off with a cold chisel for example, the pales may be removed and access gained to the area enclosed by the palisade. Also, while a pale with a generally curved cross section has good structural strength axially, it has poor strength perpendicular to the axis.

GB 2 241 721 (Murphy et al) discloses a method of joining the pales to the horizontal rails without using bolts, rivets or the like. The pale, having a cross section of a flattened trefoil shape, also features a lip along each vertical edge. A clamping plate engages with these lips, and this is then bolted or riveted to the horizontal rail. In this manner the fastening means is concealed from someone on the outside of the boundary. Similarly to a conventional pale, this pale is cold rolled.

Like a conventional pale, the pale disclosed in Murphy has poor strength perpendicular to its axis. Also the lips may deform if the pale is pulled upon, so allowing the pale to be detached from the horizontal rails.

OBJECT OF THE INVENTION

The object of the present invention is to provide a system of fencing which is both structurally strong, and conceals its means of attaching the component parts when regarded from one side of the fencing.

SUMMARY OF THE INVENTION

According to the present invention, there is provided a fencing system including a plurality of substantially vertical pales, one or more substantially horizontal rails, the rails including a substantially flat surface against which the pales are set, and holes through which a bolt or the like may pass to secure the pales.

Preferably the section of the pale is elongated parallel to the rail, and preferably includes a generally convex surface facing away from the rail, and a generally concave or re-entrant surface, the fastening means engaging with this surface and being concealed by this surface when the pale is regarded from side of the pale opposite to the concave surface.

Preferably the concave surface of the pale and surface of the rail (or an intermediate member situated between the rail and the pale) which it faces are, at least before fastening, of different shapes so that a portion of the concave surface is not directly in contact with the rail, and the fastening means pull upon this portion of the concave surface of the pale such that it becomes prestressed.

Preferably the securement means include a bolt passing through both the rail and the concave surface. Preferably the generally concave surface includes a flat central portion. The pale is preferably formed by extrusion.

According to another aspect of the present invention, there is provided a pale as herein defined, and a method of erecting a fencing system comprising supporting a rail horizontally in its intended final position, and fastening a plurality of such pales.

The pale, when viewed in cross section, has a rear wall comprising a curved surface which is arranged against the horizontal rails and attached thereto, this rear wall forming part of the hollow section. When the fence is approached from the front, the concavity of the rear wall will shield the securement means.

Furthermore, a securement means, such as a bolt, common to both the rail and the pale and which tends to pull the curved surface of the pale towards the rail, will tend to flatten the concavity and prestress the pale, making the pale more rigid against the rail and making it very difficult to gain access to the securement means through the regions where the rail and pale abut.

BRIEF DESCRIPTION OF THE DRAWING

A fencing system embodying the invention will now be described, by way of example, with reference to the drawing, of which.

SPECIFIC DESCRIPTION

Figure 1:
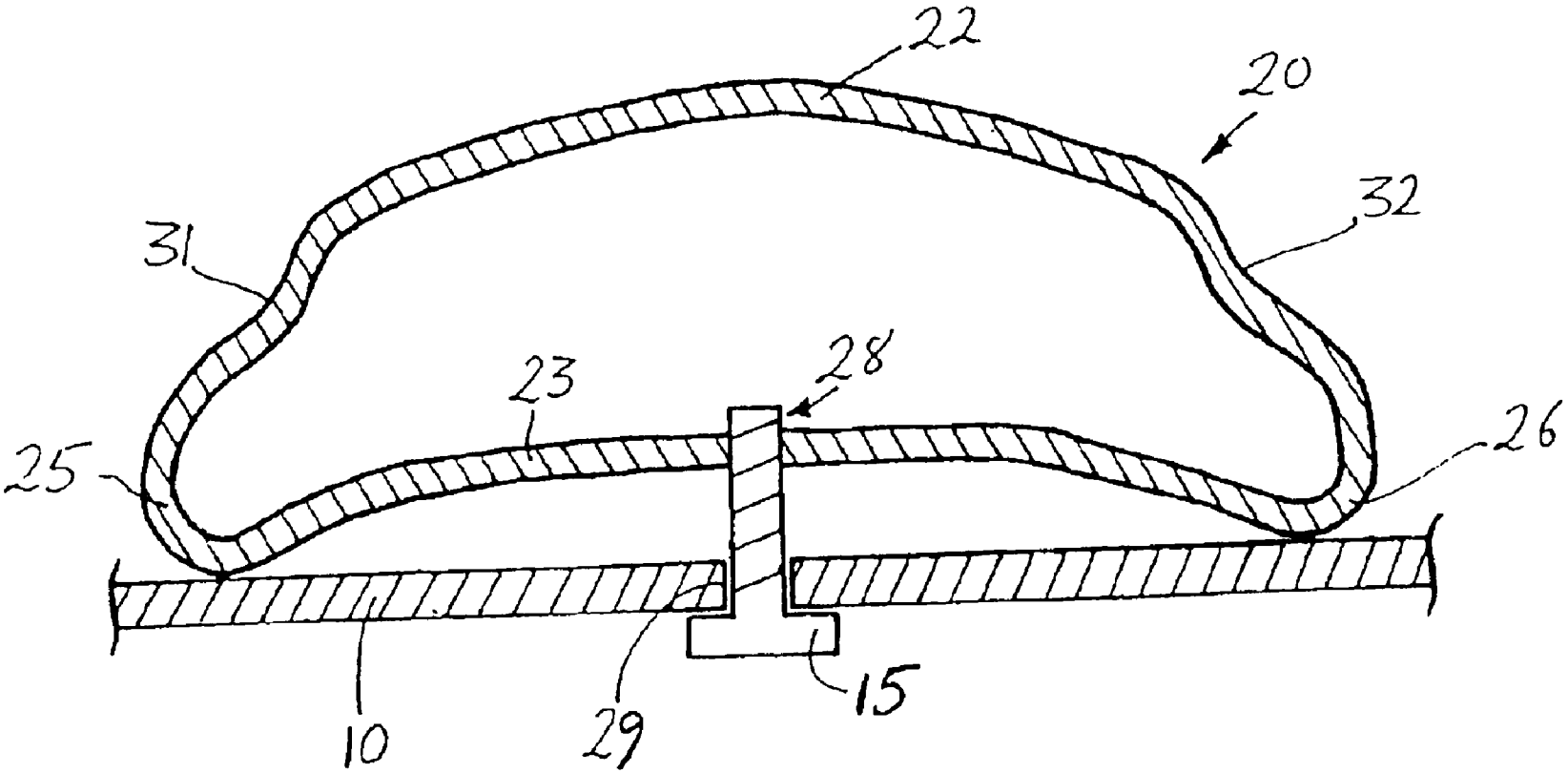
FIG. 1 is a sectional view of the pale and the horizontal rail at the attachment point.

Referring to FIG. 1, the pale 20 has a generally crescent shaped hollow cross section, including a curved front wall 22, and a curved back wall 23. Rather than cusps, the regions 25,26 where the front and back walls meet are rounded. The pale then has a concave surface (the back wall 23), and a convex surface (the front wall 22).

Figure 2:
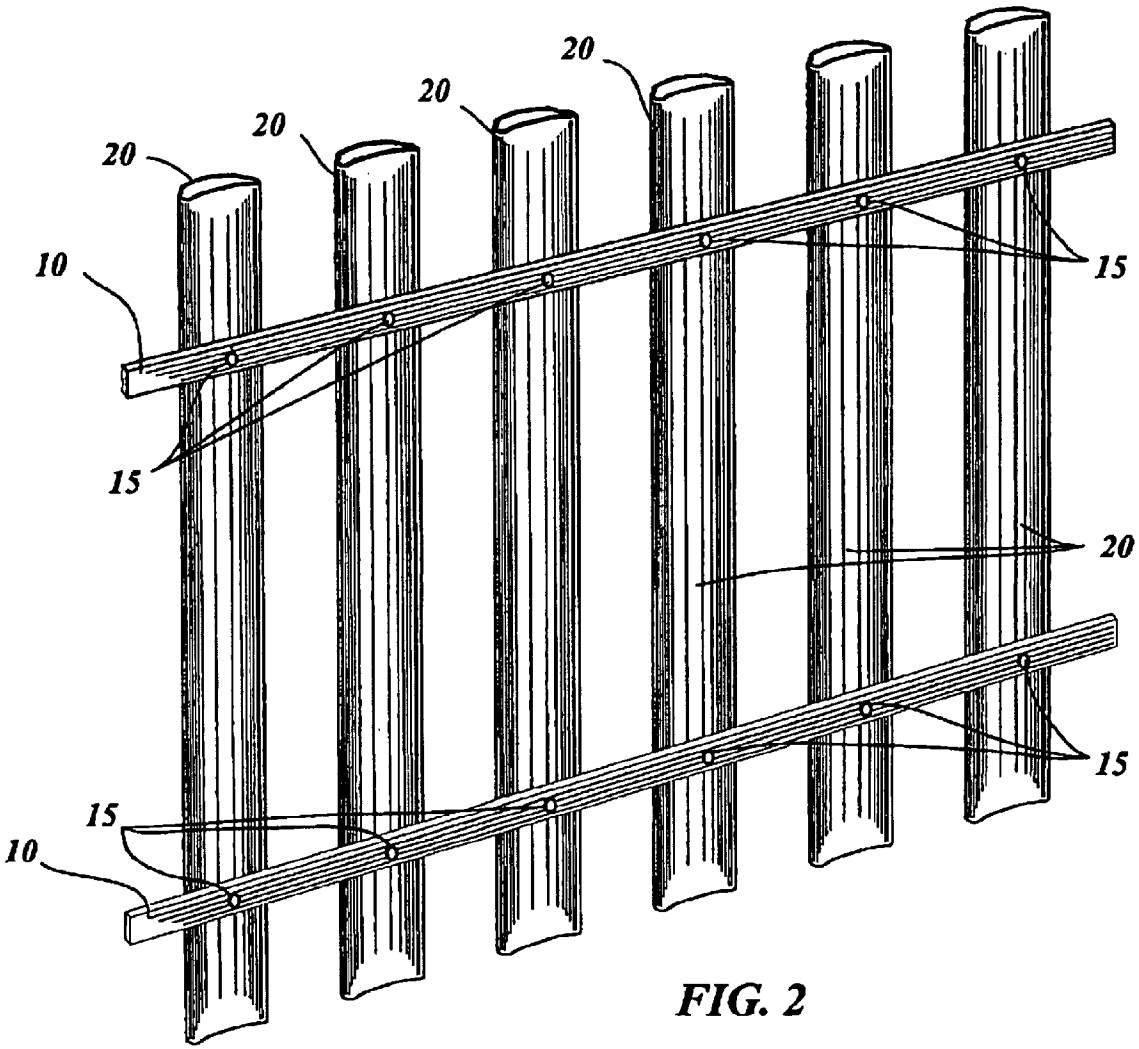
FIG. 2 is a perspective view showing a plurality of pales and fasteners.

The back wall 23 is placed against the rail 10, so that the rounded portions 25,26 rest directly against the rail. Each pale has a hole 28 centrally located in the concave surface, and the rail has corresponding holes 29 along its length. To secure the pale to the rail, the two holes 28,29 are aligned and a bolt 15 introduced to them. The generally concave surface of the back wall is substantially flat at the central region where the hole occurs. This makes it easier to form the hole 28 in the pale, and easier to introduce the bolt to the hole 28. FIG. 2 shows a number of pales 20 connected to rails 10 by the bolts 15.

The hole 28 in the pale is such a size that the thread of the bolt 15 engages with it, whilst the hole 29 of the rail is somewhat larger, the bolt being constrained against the rail by its head.

As the bolt is tightened, the back wall 23 is drawn by the bolt's thread towards the rail 10. The crescent shape of the pale is drawn somewhat flatter as the pale is stressed.

When the pale is attached to the rail in this prestressed state, the securing bolt 15 is covered by the overhanging portions of the pale 20 when considered facing the front convex wall of the pale. In order to remove the pale from this side of the fencing, an intruder would have to force a toll between one of the rounded portions 25,26 and the rail. This is difficult, since a large force is needed to overcome the prestressing of the pale.

When conventional pales are removed, the intruder will sometimes conceal that fact by resting the removed pales loosely against the pale, or temporarily fixing the pales, with chewing gum for example. To a casual observer, the pales look undamaged, but the intruder may conveniently remove the pales to gain access to the fenced off region on subsequent occasions.

The pale illustrated in FIG. 1 includes indentations 31,32 which run the length of the pale. When a large predetermined force is applied between pale and the rail, the pale buckles along the indentation. This occurs before the bolt fails. This buckling makes it obvious when a pale has been tampered with and needs replacing. Means for testing for failed bolts or rivets have been devised such as passing along the fence with a stick rapping against the pales and detecting the change in the sound which would indicate a faulty bolt or rivet. Such labor intensive testing methods are no longer required with the fencing system of this invention. These indentations are also aesthetically pleasing.

The hollow section of the pale provides great strength and rigidity perpendicular to the pale's axis, whilst losing none of the axial strength.

The horizontal rails may then be attached to vertical posts embedded in the ground in the conventional manner.

The pale is formed by extruding metal through an aperture of the required shape to produce the required cross section, though other methods could be employed. For example, the pale could be formed by rolling a shape having a similar cross section but with an open shape instead of the hollow section, and then bent and welding the shape to form the box section. Other materials, such as composite materials, could equally well be used.

At the top of the pale, the front wall could be axially subdivided and the resulting strips flared out to form an upper projection, known as a topping, in a similar way to conventional pales. Alternatively, the hollow section could be left open, and a topping fitted into the open top of the pale.

The horizontal rail 10 illustrated here is a standard strip, though rails having other cross sections could be used with equal facility. If desired, nut to be inserted into the box section and fastened to the bolt, or a rivet could be used instead of the bolt.

Equally, the rail illustrated has a uniform, flat surface facing the concave surface of the pale. The rail surface could though take a variety of shapes. It could be a convex surface with a curvature less than that of the concave surface of the pale. It could also be a convex shape corresponding to the concavity of the pale, and although no prestressing will occur, the bolt will be concealed by the pale.

The concealing portion of the pale need not be smoothly curved, but may be a re-entrant shape composed of flat surfaces and sharp angles, even to the extent of being rectangular. Naturally, the pale need not abut directly against the rail, but an intermediate member could be inserted between the rail and the pale.

What is claimed is:

1. A fencing system comprising a plurality of pales, a rail and fasteners securing said pales to said rail, each of said pales being generally tubular with an outer surface of a first wall generally concave toward said rail and an outer surface of a second wall convex away from said rail, said walls of each pale defining a space between them, at least one of said fasteners extending into the respective first wall of each pale and drawing the respective first wall against said rail with at least partial flattening of the respective first wall, said second walls being free from engagement by said fasteners.

2. The fencing system defined in claim 1 wherein said first wall defines a space between the respective pale and said rail and each of said fasteners passes through the respective space so as to draw the respective first wall resiliently against said rail.

3. The fencing system defined in claim 1 wherein each of said first walls has a flat central portion where the respective fastener engages same.

4. The fencing system defined in claim 1 wherein each of said first walls has a thickened portion where the respective fastener engages same.

5. The fencing system defined in claim 1 wherein each of said first walls has a thread engaging in the respective hole.

6. The fencing system defined in claim 1 wherein said walls adjoin at rounded regions abutting said rail for each of said pales.

7. The fencing system defined in claim 1 wherein each of said pales has a generally crescent shape hollow cross section having rounded regions between said walls and abutting said rail.

8. The fencing system defined in claim 1 wherein each of said pales has longitudinal indentations inducing buckling of the pale when each pale is subject to a predetermined force less than that required to break the respective fasteners and detach the pale from the rail.

* * * * *